US008658900B2

(12) United States Patent
Picard et al.

(10) Patent No.: US 8,658,900 B2
(45) **Date of Patent: *Feb. 25, 2014**

(54) METAL SHEATHED CABLE ASSEMBLY

(75) Inventors: Paul R. Picard, East Greenwich, RI (US); Robert A. Pereira, Rochester, MA (US); Christopher J. DeMello, Swansea, MA (US); Joseph D. Colangelo, Chepachet, RI (US)

(73) Assignee: WPFY, Inc., Wilmington, DE (US)

( * ) Notice: Subject to any disclaimer, the term of this patent is extended or adjusted under 35 U.S.C. 154(b) by 754 days.

This patent is subject to a terminal disclaimer.

(21) Appl. No.: 12/419,607

(22) Filed: Apr. 7, 2009

(65) Prior Publication Data

US 2009/0250239 A1 Oct. 8, 2009

Related U.S. Application Data

(60) Provisional application No. 61/042,935, filed on Apr. 7, 2008, provisional application No. 61/098,565, filed on Sep. 19, 2008.

(51) Int. Cl.
*H01B 11/00* (2006.01)

(52) U.S. Cl.
USPC ..... 174/113 R

(58) Field of Classification Search
USPC ..... 174/102 R, 113 R, 120 R, 108, 109, 174/102 D
See application file for complete search history.

(56) References Cited

U.S. PATENT DOCUMENTS 2,866,843 A * 12/1958 Arman ..... 174/25 R
3,032,604 A 5/1962 Timmons
3,829,603 A 8/1974 Hansen et al.
4,374,299 A 2/1983 Kincaid
4,943,699 A 7/1990 Thommes
4,956,523 A 9/1990 Pawluk
5,043,538 A 8/1991 Hughey, Jr. et al.
5,220,130 A * 6/1993 Walters ..... 174/36
5,246,783 A 9/1993 Spenadel et al.
5,281,762 A 1/1994 Long et al.
5,329,064 A 7/1994 Tash et al.
5,329,065 A 7/1994 Marney et al.
5,414,217 A 5/1995 Neuroth et al.

(Continued)

FOREIGN PATENT DOCUMENTS

CN 200990698 Y 12/2007

OTHER PUBLICATIONS

UL Standard for Safety for Metal-Clad Cables, UL 1569, "Metal-Clad Cables," Third Edition, dated Aug. 31, 1999, Redacted pp. 9,10, 14,21, 31,46A-46C, 46D-48, 54A.

(Continued)

*Primary Examiner* — Chau Nguyen

(74) *Attorney, Agent, or Firm* — Kacvinsky Daisak Bluni PLLC

(57) ABSTRACT

An AC cable that includes at a plurality of conductor assemblies within a metal armored sheath. Each conductor assembly has an electrical conductor, an insulation layer extending around and along the length of each of the electrical conductors, a jacket layer disposed around the insulating layer and a polymeric protective layer disposed around the jacket layer along the length of each of the electrical conductors. A bonding strip is disposed within the metal sheath and is in contact with the interior surface of the metal sheath to provide an electrical low-impedance fault return path for the AC cable.

14 Claims, 7 Drawing Sheets

(56) References Cited

U.S. PATENT DOCUMENTS

| | | | | |
|---|---|---|---|---|
| 5,416,268 | A | 5/1995 | Ellis | |
| 5,426,264 | A | 6/1995 | Livingston et al. | |
| 5,431,759 | A | 7/1995 | Neuroth | |
| 5,451,718 | A | 9/1995 | Dixon | |
| 5,486,649 | A | 1/1996 | Gareis | |
| 5,574,250 | A | 11/1996 | Hardie | |
| 5,920,032 | A | 7/1999 | Aeschbacher et al. | |
| 6,010,788 | A | 1/2000 | Kebabjian et al. | |
| 6,255,592 | B1 | 7/2001 | Pennington et al. | |
| 6,281,443 | B1 | 8/2001 | Idler | |
| 6,485,335 | B1 | 11/2002 | Dewdney | |
| 6,486,395 | B1 | 11/2002 | Temblador | |
| 6,743,387 | B2 | 6/2004 | Belli et al. | |
| 6,815,617 | B1 | 11/2004 | Gebs | |
| 6,906,264 | B1 | 6/2005 | Grant, Jr. et al. | |
| 6,998,538 | B1 | 2/2006 | Fetterolf et al. | |
| 7,049,506 | B2 | 5/2006 | Head | |
| 7,129,415 | B1 * | 10/2006 | Bates et al. | 174/110 R |
| 7,148,422 | B2 | 12/2006 | Hopper | |
| 7,166,802 | B2 | 1/2007 | Cusson et al. | |
| 7,332,676 | B2 | 2/2008 | Sparrowhawk | |
| 8,088,997 | B2 * | 1/2012 | Picard et al. | 174/36 |
| 2001/0040041 | A1 | 11/2001 | Pennington et al. | |
| 2004/0065469 | A1 | 4/2004 | Goldlust et al. | |
| 2006/0102380 | A1 * | 5/2006 | Hu | 174/120 R |
| 2007/0056762 | A1 | 3/2007 | Cusson et al. | |
| 2008/0050588 | A1 | 2/2008 | Broman et al. | |
| 2008/0217044 | A1 | 9/2008 | Carlson et al. | |
| 2009/0250238 | A1 | 10/2009 | Picard et al. | |

OTHER PUBLICATIONS

Supplementary European Search Report dated Dec. 7, 2012, for corresponding European Patent Application No. 09730575.9.

* cited by examiner

METAL SHEATHED CABLE ASSEMBLY

CROSS-REFERENCE TO RELATED APPLICATIONS

This application claims priority to U.S. Provisional Application No. 61/042,935 filed Apr. 7, 2008 and U.S. Provisional Application No. 61/098,565 filed Sep. 19, 2008 which is herein incorporated by reference in its entirety.

BACKGROUND OF THE INVENTION

1. Field of the Invention

The present invention is directed toward a type AC Armored Cable. More particularly, the present invention relates to a type AC THH armored cable assembly which includes electrical conductors each having a conventional layer of insulation, a jacketing layer and an extruded protective layer.

2. Discussion of Related Art

Armored cable ("AC") and Metal-Clad ("MC") cable provide electrical wiring in various types of construction applications. The type, use and composition of these cables must satisfy certain standards as set forth, for example, in the National Electric Codes (NEC®). These cables house electrical conductors within a metal armor. The metal armor may be flexible enabling the cable to bend while protecting the conductors against external damage during and after installation. The armor which houses the electrical conductors may be made from steel or aluminum. Typically, the metal armor sheath is formed from strip steel, for example, which is helically wrapped to form a series of interlocked "S" shaped sections along a longitudinal length of the cable.

Generally, AC and MC cable have different internal constructions and performance characteristics and are governed by different standards. For example, MC cable is manufactured according to UL standard 1569 and includes a conductor assembly with no limit on the number of electrical conductors having a particular AWG (American Wire Gauge). The conductor assembly may contain a grounding conductor. The electrical conductors and the ground conductor are cabled together in a left or right hand lay, but must end in a left hand lay. The conductors are encased collectively in an overall covering. In particular, MC cable includes either a covering over all of the electrically insulated conductors and the grounding conductor after cabling or a covering over just the electrical insulated conductors combined after cabling while the grounding conductor is positioned externally separate from this overall covering. The assembly is then fed into an armoring machine where metal tape is helically applied around the assembly to form a metal sheath. The metallic sheath of MC cable may be used as an equipment grounding conductor if the ohmic resistance satisfies the requirements of UL 1569. A grounding/bonding conductor may be included which, in combination with the metallic sheath, satisfies the UL ohmic resistance requirement. In this case, the metallic sheath and the grounding/bonding conductor would compose what is referred to as a metallic sheath assembly.

In contrast, AC cable is manufactured to UL Standard 4 in accordance with Section 320 of the National Electrical Code NEC® and can only contain up to four (4) insulated conductors (copper, aluminum, etc.) which are cabled together in a left hand lay as per Section 5.5 of UL Standard 4. Each electrical conductor is covered with a thermoplastic insulation and a jacket layer which are individually wrapped in a fibrous material. Similar to MC cable, the electrical conductors are disposed within a metal armor or sheath. If a grounding conductor is employed in AC cables, the grounding conductor is either (i) separately covered or wrapped with the fibrous material before being cabled for thermoplastic insulated conductors; or (ii) enclosed in the fibrous material together with the insulated conductors for thermoset insulated conductors. In either configuration, the bare grounding conductor is prevented from contacting the metal armor by the fibrous material. Additionally in AC type cable, a bonding strip or wire is laid lengthwise longitudinally (not cabled) along the conductors and is in intimate contact with the metal armor or sheath providing a low-impedance fault return path to safely conduct fault current.

The bonding strip for AC cable is composed of a minimum 16 AWG aluminum strip or wire. The bonding strip is unique to AC cable and allows the outer metal armor or sheath in conjunction with the bonding strip to provide a low impedance equipment grounding path. NEC® Section 320-104 provides that each electrically insulated conductor in an AC cable is covered with an overall moisture-resistant and fire-retardant fibrous material and if a grounding conductor is used, the fibrous material is disposed between the ground wire and the metal armored sheath. This provides that the ground conductor is separate from the bonding strip and allows the bonding strip to be in electrical contact with the interior surface of the metal sheath to provide the low impedance equipment grounding path. However, the fibrous material used to wrap each circuit conductor and ground conductor requires additional time and manpower during use and installation. In particular, an installer must first unwrap the fibrous material to expose the insulation/jacket before cutting the conductors required to complete a desired connection. In addition, the fibrous material may be subject to decomposition which may compromise the mechanical protection of the cable. Although the fibrous material may provide some moisture resistance and may be flame retardant, it may not provide a sufficient level of these properties for a particular application and/or location. Moreover, if moisture does penetrate into the fibrous material, the moisture will not wick away thereby potentially compromising the cable. Thus, there is a need for an improved AC cable that overcomes the drawbacks of the prior art.

SUMMARY OF THE INVENTION

Exemplary embodiments of the present invention are directed to an AC cable. In an exemplary embodiment, the AC cable includes a plurality of conductor assemblies, a bonding strip and a metal sheath housing the plurality of conductor assemblies and the bonding strip. Each of the conductor assemblies has an electrical conductor, a layer of insulation extending around and along the length of each of the electrical conductors, a jacket layer and a polymeric protective layer disposed around the insulation layer along the length of each of the electrical conductors. The metal sheath is disposed over the plurality of conductor assemblies and the bonding strip is disposed within the metal sheath and in electrical contact with an interior surface of the metal sheath.

DESCRIPTION OF EMBODIMENTS

Figure 1:
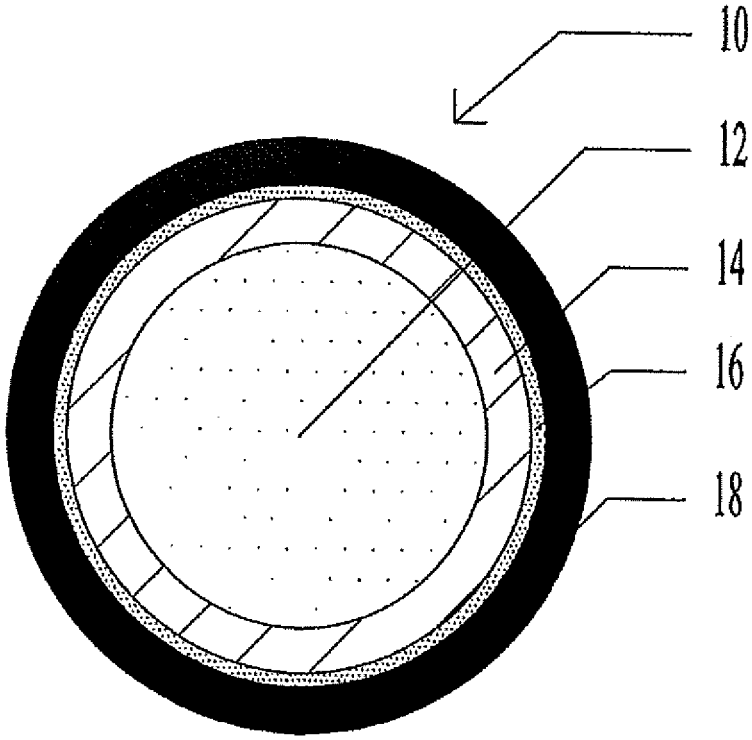
FIG. 1 is a cross sectional view of an exemplary THHN electrical conductor assembly in accordance with the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a cross sectional view of an exemplary electrical conductor assembly 10 used in an AC cable. The electrical conductor assembly 10 has a generally circular cross section and includes a stranded or solid electrical conductor 12 having conventional insulation layer 14 and a jacket layer 16 disposed on conventional insulation layer 14. The electrical conductor 12, insulation layer 14 and jacket layer 16 define an NEC® type THHN or THWN insulated conductor where the insulation layer 14 may be PVC and jacket layer 16 may be nylon. A polymeric protective layer 18 is disposed on jacket layer 16 and more particularly, is extruded over jacket layer 16. Protective layer 18 is polypropylene, but may also be made from polyethylene or similar polymeric material. Protective layer 18 may also be a foamed polymeric material that includes air pockets filled with gasses, some or all of which may be inert. Protective layer 18 provides mechanical strength to resist buckling, crushing and scuffing and may also provide proper positioning and tensioning of a ground conductor as described below. The protective layer 18 may also be pliable to provide a conforming surface to that of the inside of the metal sheath or adjacently positioned conductor assemblies.

Figure 1A:
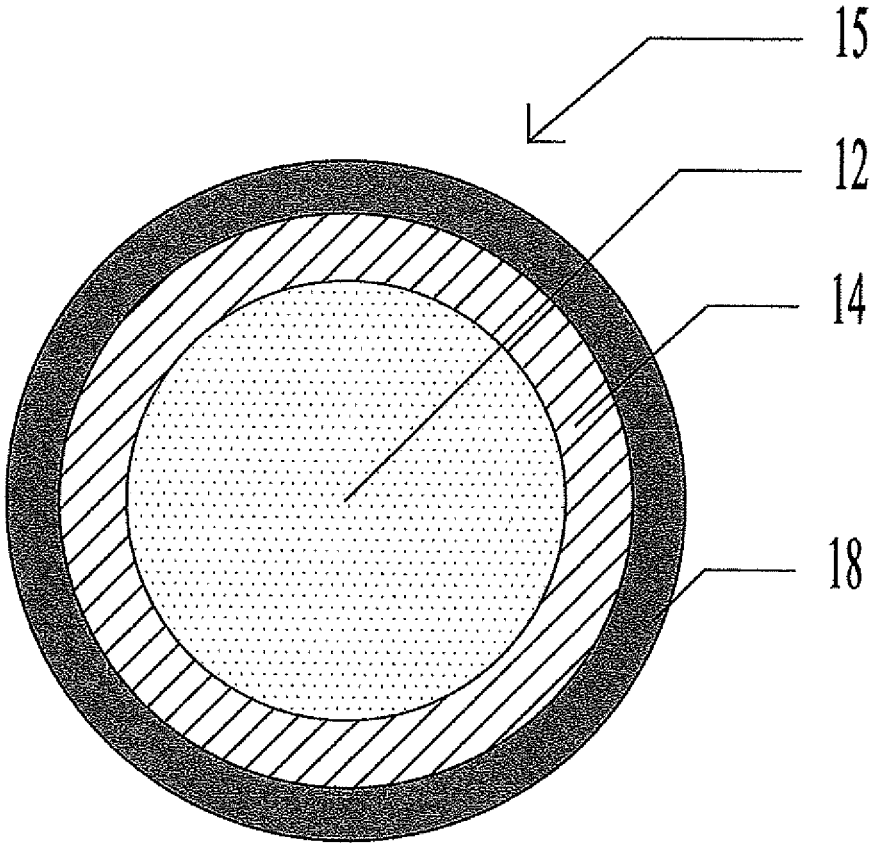
FIG. 1A is a cross sectional view of an exemplary electrical conductor assembly in accordance with the present invention.

FIG. 1A is a cross sectional view of an electrical conductor assembly 15 including a stranded or solid electrical conductor 12 having conventional insulation layer 14 and a protective layer 18. Unlike the conductor assembly 10 of FIG. 1 where the protective layer 18 is disposed over the jacket layer 16, the protective layer 18 of conductor assembly 15 is disposed over insulation layer 14. Protective layer 18 is polypropylene, but may also be made from polyethylene or similar polymeric material. Protective layer 18 may be a foamed polymeric material that includes air pockets filled with gasses, some or all of which may be inert. Protective layer 18 provides mechanical strength to resist buckling, crushing and scuffing of the conductor assembly 15.

Figure 2:
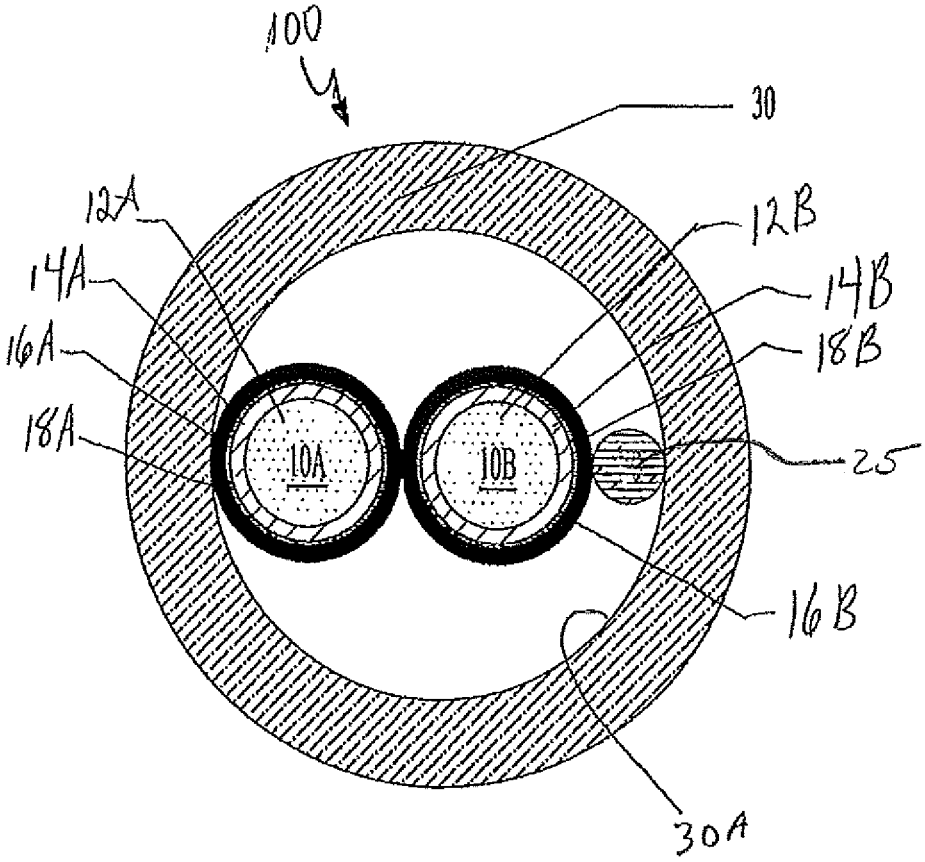
FIG. 2 is a cross-section view of an exemplary AC cable 100 in accordance with the present invention.

FIG. 2 is a cross sectional view of an AC cable 100 including a metal sheath 30 housing electrical conductor assemblies 10A, 10B and a bonding strip or strip 25. The electrical conductor assemblies 10A-B have the same configuration as conductor assembly 10 shown in FIG. 1. In particular, conductor assembly 10A includes electrical conductor 12A having surrounding insulation layer 14A, jacket layer 16A and polymeric protective layer 18A. Similarly, conductor assembly 10B includes electrical conductor 12B having surrounding insulation layer 14B, jacket layer 16B and polymeric protective layer 18B. The metal sheath or armor 30 has a generally circular cross section with a minimum thickness of about 0.025 inches. Sheath 30 may be formed from a flat metal strip that is helically wrapped, the edges of which interlock to form a series of "S" shaped convolutions along the length of the cable. In this manner, the metal sheath allows cable 100 to have a particular bend radius sufficient for installation within a building or structure. The sheath may also be formed into shapes other than generally circular such as, for example, rectangles, polygons, ovals and the like. Thus, metal sheath 30 provides a hollow area within which conductor assemblies 10A-B and bonding strip 25 are housed while providing a protective covering for the conductors. The electrical conductor assemblies 10A, 10B are cabled together wherein the conductors are twisted longitudinally together with a left-handed lay in accordance with the lay requirements defined in Section 5.5 of UL Standard 4. Bonding strip 25 may be a strip of thin bare aluminum which is laid longitudinally along the cable 100 in intimate contact with the interior surface 30A of metal armored sheath 30. The bonding strip is not cabled with conductor assemblies 10A-B and is parallel with the metal sheath 30 to form an electrically conductive path having the capacity to safely conduct fault current likely to be imposed on cable 100.

Figure 3A:
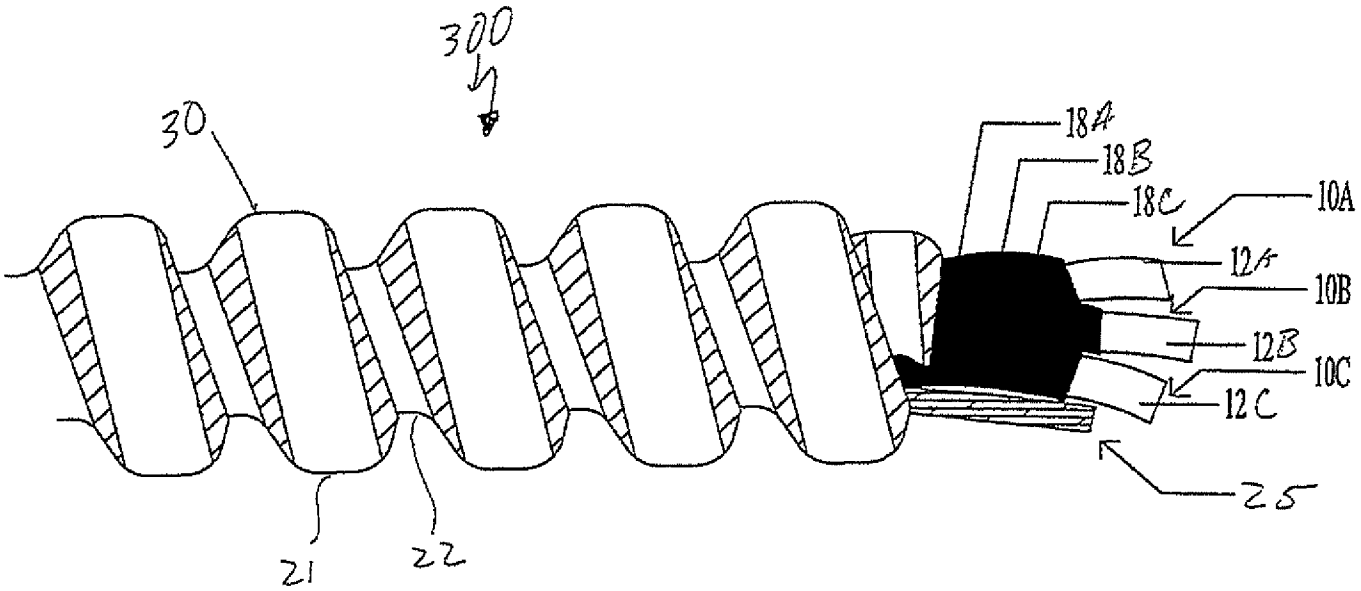
FIG. 3A is a side view of an exemplary AC cable 300 in accordance with the present invention.
Figure 3B:
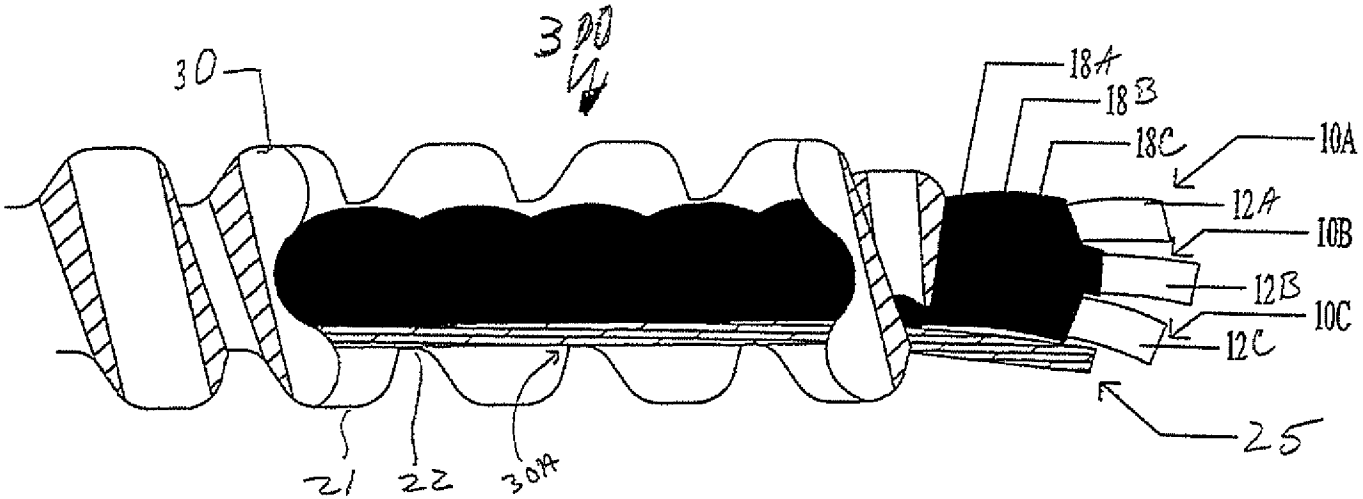
FIG. 3B is a cut-away side view of the exemplary AC cable 300 shown in FIG. 3A in accordance with the present invention.

FIG. 3A is a side plan view of cable 300 illustrating metal sheath 30 sized to receive electrical conductor assemblies 10A, 10B and 10C as well as bonding strip 25. Similar to conductor assembly 10 of FIG. 1, each of the conductor assemblies 10A-C comprises electrical conductors 12A-C insulating layers 14A-C, jacket layers 16A-C and protective layers 18A-C, respectively. One of the conductor assemblies 10A, 10B or 10C may be a ground conductor where the respective insulating layer 14A-C ensures that the ground conductor does not come in contact with metal sheath 30. The conductor assemblies 10A-C are cabled together and bonding strip 25 is laid longitudinally along the axis of the cabled conductor assemblies. This may be seen more clearly in FIG. 3B which is a view of cable 300 where a portion of sheath 30 is cut-away. In particular, conductor assemblies 10A-C are cabled and bonding strip 25 is laid longitudinally along the length of cable 300 and is not cabled with conductor assemblies 10A-C. The metal strips which are helically wrapped and interlocked to form a series of "S" shaped convolutions which comprise sheath 30 define a series of crowns 21 and troughs 22 along the length of cable 300. Because bonding strip 25 is laid longitudinally within sheath 30, bonding strip 25 contacts the series of troughs 22 along the interior surface 30A of sheath 30 along the length of cable 300. In this manner, bonding strip 25 is in direct contact with the interior surface 30A of metal armored sheath 30 to form an electrically conductive path having the capacity to safely conduct fault current likely to be imposed on cable 300.

Figure 4:
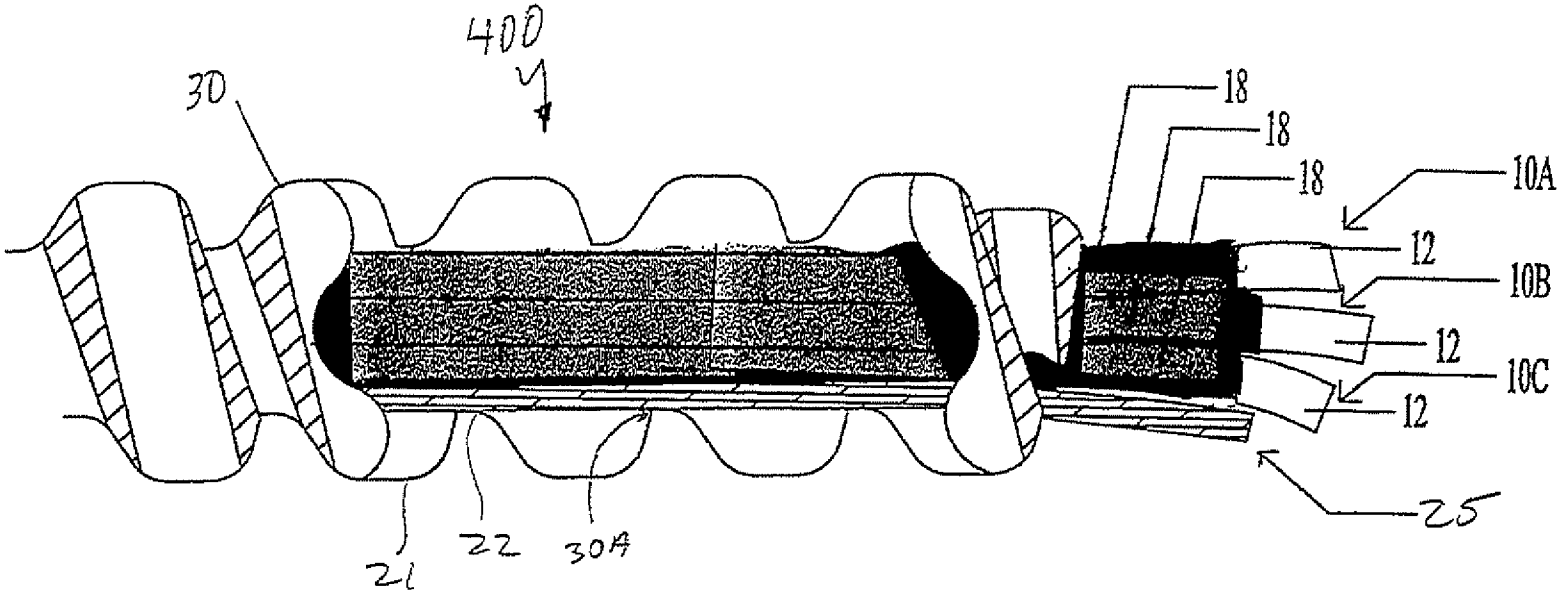
FIG. 4 is a cut-away side view of an exemplary AC cable 400 in accordance with an embodiment of the present invention.

FIG. 4 is a side view of AC cable 400 where a portion of sheath 30 is cut-away. Metal sheath 30 is sized to receive electrical conductor assemblies 10A, 10B and 10C as well as bonding strip 25. Similar to conductor assembly 10 of FIG. 1, each of the conductor assemblies 10A-C comprises electrical conductors 12A-C insulating layers 14A-C, jacket layers 16A-C and protective layers 18A-C, respectively. One of the conductor assemblies 10A, 10B or 10C may be a ground conductor where the respective insulating layer 14A-C ensures that the ground conductor does not come in contact with metal sheath 30. In this embodiment, conductor assemblies 10A-C are not cabled together, but rather extend longitudinally along the metal sheath 30 such that a longitudinal axis of the conductors is parallel to a longitudinal axis of sheath 30. Bonding strip 25 is laid longitudinally along the axis of the cabled conductor assemblies 10A-C such that the conductor assemblies 10A-C and the bonding strip 25 are generally parallel along the respective longitudinal axes. Bonding strip 25 contacts the interior surface 30A of sheath 30 along the series of troughs 22 formed by the helically wrapped "S" configurations. In this manner, bonding strip 25 is in direct contact with the interior surface 30A of metal armored sheath 30 to form an electrically conductive path having the capacity to safely conduct fault current likely to be imposed on cable 400.

Figure 5:
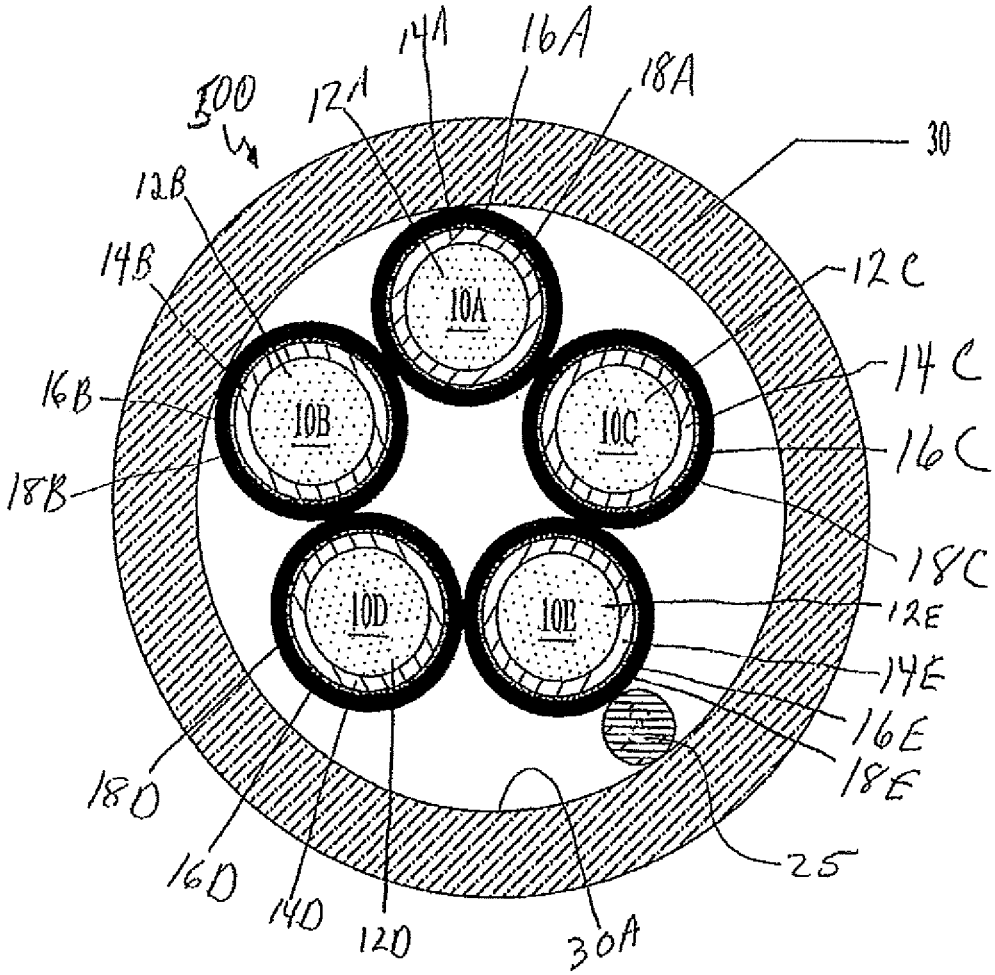
FIG. 5 is a cross sectional view of an exemplary AC cable 500 in accordance with an embodiment of the present invention.

FIG. 5 is a cross sectional view of AC cable 500 having metal sheath 30 sized to receive a plurality of electrical conductor assemblies 10A-E. Since AC cable can only have up to four (4) electrical conductors and cable 500 has five (5) conductor assemblies (10A-E), one of the conductor assemblies 10A-E must be a ground conductor. For ease of explanation, conductor assembly 10E is designated as the ground conductor, but any of the assemblies 10A-E may be the ground conductor. Each of the conductor assemblies 10A-E has the same configuration as the conductor assemblies 10 described above including conductors 12A-E, insulation layers 14A-E, jacket layers 16A-E and protective layers 18A-E respectively. Again, each of the protective layers 18A-E is constructed from a polymeric material adapted for coaxial extrusion. The conductor assemblies 10A-E are cabled together and bonding strip 25 is laid longitudinally along the axis of the cabled conductor assemblies such that bonding strip 25 is in contact with the interior surface 30A of metal sheath 30. Conductor assembly 10E is a ground conductor and is insulated from contact with bonding strip 25 and the interior surface 30A of metal sheath 30.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. An AC cable comprising:

a plurality of conductor assemblies, each of said conductor assemblies having an electrical conductor, a layer of polyvinylchloride insulation extending around and along the length of each of said electrical conductors, and a polymeric protective layer disposed around said insulation layer along the length of each of said electrical conductors, said protective layer made from a material that is different from said layer of insulation;

a nylon jacket layer disposed between said polyvinylchloride insulation layer and said protective layer for each of said plurality of conductor assemblies;

a metal sheath disposed over said plurality of conductor assemblies; and a bonding strip disposed within said metal sheath and in intimate contact with an interior surface of said metal sheath.

2. The AC cable of claim 1 wherein said plurality of conductor assemblies are twisted in a cabled relationship.

3. The AC cable of claim 1 wherein at least one of said plurality of conductor assemblies is a grounding conductor.

4. The AC cable of claim 3 wherein said plurality of conductor assemblies are twisted in a cabled relationship.

5. The AC cable of claim 1 wherein said metal sheath and said bonding strip define a low-impedance fault return path for said cable.

6. The AC cable of claim 1 wherein said metal sheath comprises a metal strip that is helically wound such that edges of said metal strip interlock around said plurality of conductor assemblies.

7. The AC cable of claim 6 wherein said helically wound metal strip forms a series of crowns and troughs, said bonding strip being in contact with the interior surface of said troughs.

8. The AC cable of claim 1 wherein said polymeric layer is adapted for extrusion about the insulation layer.

9. The AC cable of claim 1 wherein said protective layer is adapted for extrusion about said jacket layer along the length of each of said conductor assemblies.

10. The AC cable of claim 1, wherein said protective layer is made from a material that is different from said nylon jacket layer to enable a user to remove said protective layer from said jacket layer during installation of said AC cable.

11. The AC cable of claim 1 wherein the protective layer includes gas pockets.

12. The AC cable of claim 11, wherein the gas pockets include an inert gas.

13. The AC cable of claim 11, wherein the protective layer is a foamed polymeric material.

14. The AC cable of claim 1 wherein the protective layer is pliable to provide a conforming surface to that of the inside of the metal sheath.

* * * * *